United States Patent [19]

Zigman

[11] Patent Number: 4,669,615

[45] Date of Patent: Jun. 2, 1987

[54] FOOTWEAR HANGER

[76] Inventor: Donald J. Zigman, 5569 S. 116 St., Hales Corners, Wis. 53130

[21] Appl. No.: 839,839

[22] Filed: Mar. 13, 1986

Related U.S. Application Data

[63] Continuation-in-part of Ser. No. 579,194, Feb. 10, 1984, Pat. No. 4,576,290.

[51] Int. Cl.[4] ..... A47F 7/08

[52] U.S. Cl. ..... 211/34; 211/119

[58] Field of Search ..... 211/34, 35, 38, 113, 211/37, 119; 248/316.5, 316.6, 317, 305; 84/566, 567, 343, 530

[56] References Cited

U.S. PATENT DOCUMENTS

| | | | |
|---|---|---|---|
| 97,081 | 11/1869 | Griswold | 248/317 |
| 2,284,552 | 5/1942 | Arenz | 211/35 |
| 2,376,097 | 5/1945 | Stamm | 211/34 |
| 2,641,366 | 6/1953 | Burch | 211/38 |
| 2,787,379 | 4/1957 | Fritz et al. | 211/38 |
| 2,812,066 | 11/1957 | Volosin | 211/34 |
| 2,969,151 | 1/1961 | Kvstulovich | 211/34 |
| 3,317,054 | 5/1967 | Gies | 211/34 |
| 3,802,572 | 4/1974 | Shackel | 211/38 |

FOREIGN PATENT DOCUMENTS

| | | | |
|---|---|---|---|
| 154348 | 9/1938 | Austria | 211/34 |
| 781810 | 4/1968 | Canada | 211/34 |
| 231226 | 3/1944 | Switzerland | 211/34 |

OTHER PUBLICATIONS

"Post", Delta Arms Sporting Goods of Indianola MS, admitted prior art.

"Hardy's Solution", Dunn's of Tennessee, admitted prior art.

"S" Hook, admitted prior art.

*Primary Examiner*—Robert W. Gibson, Jr.

*Attorney, Agent, or Firm*—Quarles & Brady

[57] ABSTRACT

A hanger for suspending a pair of footwear in an inverted position, each one of said pair having a heel, a sole, and an upper is disclosed. The hanger has a pair of clamps made of wire, each of the clamps being for each one of the pair of footwear. Each clamp has a torsion spring coil at one end wherein front and rear ends of the coil extend downwardly from the coil to define respective first and second vertical legs. Each vertical leg is formed inwardly toward the other leg at about the same distance from the coil to define respective first and second horizontal legs in side-to-side contact with one another. The vertical legs cross one another laterally so that the first horizontal leg is behind the second horizontal leg. The horizontal legs are formed 180° to define opposed gripper ends for clamping the heel of the footwear between them and each gripper end is in a plane which is perpendicular to the plane defined by the vertical and horizontal legs with which the gripper end is integral. The clamps are suspended by a hook having a balanced yoke at its lower end.

9 Claims, 2 Drawing Figures

FOOTWEAR HANGER

This is a continuation-in-part of U.S. patent application Ser. No. 579,194 filed Feb. 10, 1984, now issued as U.S. Pat. No. 4,576,290 on Mar. 18, 1986.

BACKGROUND OF THE INVENTION

This invention relates to an improved footwear hanger for suspending footwear in an inverted position.

Footwear such as boots and waders is advantageously hung in an inverted position for display, drying or storage. The inverted position maintains the uppers of the footwear in a natural extended position to help prevent cracking, checking or other deterioration of the footwear. This position also allows air to circulate more thoroughly around and inside the footwear and prevents rodents from nesting inside the footwear.

However, the type of footwear which is most advantageously stored in the inverted position is usually very heavy. Therefore, a considerable force must be applied just to suspend the footwear. To apply the necessary force, some prior footwear hangers have clamped the upper in the area between the upper and the sole, so as to rely upon contact between the hanger and the lower side (when the footwear is inverted) of the sole to support the footwear. However, clamping the upper in this way has the disadvantage of possibly marring or permanently disfiguring it. Other prior hangers have attempted to clamp the sides of the sole. In these, it has been found that so much force must be applied to the sides to keep the footwear from slipping away from the hanger that a moment is developed which tends to twist the footwear relative to the hanger. To counteract this twisting moment, the ends of prior hangers have been sharpened, which mars the footwear, or the ends have been made to act along the same line of force, which is difficult to maintain. Therefore, a need exists for a footwear hanger which suspends footwear in an inverted position, resists marring the footwear, and counteracts the twisting moment to which the footwear is subject.

SUMMARY OF THE INVENTION

This invention provides a footwear hanger which securely holds footwear in an inverted position while resisting marring the footwear and counteracting twisting moments to which the footwear is subjected. The hanger includes a clamp made of wire, with the clamp having a torsion spring coil at one end. The ends of the coil extend downwardly from the coil to define vertical legs. Each vertical leg is formed inwardly toward the other leg at approximately the same distance from the coil to define horizontal legs in side-to-side contact with one another. The vertical legs cross one another laterally and are formed 180° to define opposed gripper ends to clamp the heel of the footwear between them. Means for suspending the wire clamp are also provided. This structure, particularly in having the vertical legs cross one another laterally, helps resist the footwear twisting relative to the coil and the consequent separation of the legs which results in the footwear being released from the hanger.

In another aspect, each gripper end is in a plane which is perpendicular to the plane defined by the vertical and horizontal legs with which the gripper end is integral. Both gripper ends are formed on the same side of the clamp. This enables mounting the clamp to the footwear with the horizontal legs proximate to the front wall of the heel so the legs will contact the front wall if the footwear begins to twist relative to the clamp. Such contact between the front wall of the heel and the clamp also helps resist the footwear twisting relative to the clamp.

In a preferred form, a loose fitting ring encircles each pair of horizontal legs. This ring ensures against separation or overflexing of the legs in handling or extreme conditions of use, which may otherwise cause permanent deformation of the hanger.

In yet another aspect, the horizontal legs are formed so that they are in line contact when the footwear is received between the gripper ends. Because the horizontal legs are biased together, being in line contact further helps offset the twisting moment which tends to separate the legs.

Preferably, a pair of the clamps are provided so that a pair of footwear may be held by a single hanger. The suspending means comprises a hook having a lower end formed as an eye and a yoke having a pair of ends and a balance point midway between the ends. The ends and the balance point of the yoke are each formed as an eye. The balance point is received by the eye of the hook and the coil of each wire clamp is received by one of the ends.

It is therefore a primary object of the invention to provide a footwear hanger which resists moments which tend to twist the footwear relative to the hanger and the consequent separation of the hanger legs.

It is another object of the invention to provide a footwear hanger which resists marring the footwear.

It is another object of the invention to provide a footwear hanger that resists permanent deformation in handling and extreme conditions of use.

These and other objects and advantages of the invention will become apparent from the following detailed description and drawings.

DETAILED DESCRIPTION OF THE PREFERRED EMBODIMENT

Figure 1:
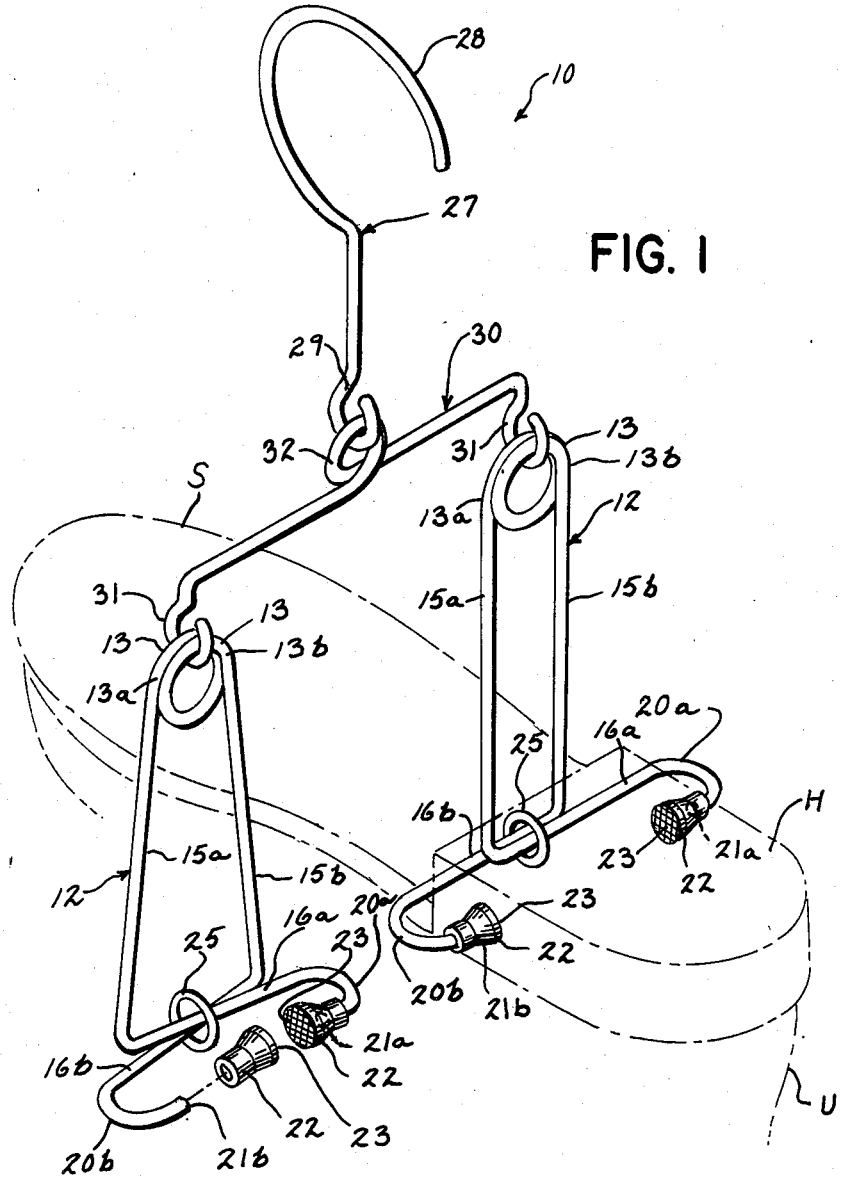
FIG. 1 is a perspective view of a footwear hanger of the invention shown with a right side clamp in a flexed position to hold a piece of footwear shown in phantom and with a left side clamp shown unflexed and partially disassembled.

Referring to FIG. 1, a hanger 10 for suspending footwear having a heel H, a sole S and an upper U in an inverted position is shown. Only one piece of footwear is shown mounted in the hanger for illustration, although the hanger of the preferred embodiment has two clamps 12, each of which can hold one piece of footwear.

Each clamp 12 is formed from a suitable gauge wire which is preferably plated to resist corrosion. Each clamp 12 has a torsion spring coil 13 at its upper end. The coil 13 is formed with one and one-half turns of the wire and front and rear ends 13*a* and 13*b*, respectively, of the coil extend downwardly from the coil to define vertical legs 15*a* and 15*b*. At approximately the same distance from the coil, the vertical legs 15*a* and 15*b* are formed inwardly toward the other leg to define horizontal legs 16*a* and 16*b* which are in side-to-side contact with one another.

When the footwear is clamped, the horizontal legs 16*a* and 16*b* are in approximately the same horizontal plane so that there is line contact between them. When no footwear is clamped, that is, as in the left clamp 12 of the hanger 10 wherein the clamp 12 is unflexed, the horizontal legs 16*a* and 16*b* are in side-to-side contact but are not in line contact. However, when the left clamp 12 is flexed to hold a piece of footwear, the horizontal legs 16*a* and 16*b* will be aligned in approximately the same horizontal plane, as in the right clamp 10, so that they will be in line contact.

Figure 2:
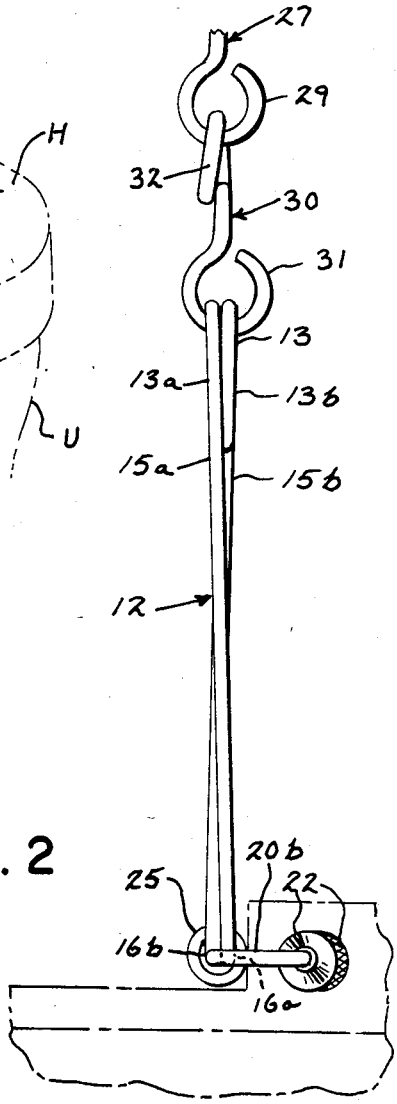
FIG. 2 is a left side elevation view of one of the clamps shown flexed and attached to a piece of footwear shown in phantom.

Referring now to FIG. 2, it is shown that the vertical legs 15*a* and 15*b* cross one another laterally. That is, the leg 15*a*, which is an extension of the front end 13*a* of the coil 13, crosses over the vertical leg 15*b*, which is an extension of the rear side 13*b* of the coil 13, so that the horizontal leg 16*a* is behind the horizontal leg 16*b*. This lateral crossing over of the vertical legs has two effects. One is that the turns of the coil 13 are held tightly together. Another is that the horizontal legs 16*a* and 16*b* are biased together. Both of these effects combine to make the clamp 12 particularly rigid to resist twisting of the footwear relative to the clamp. Note that biasing the horizontal legs 16*a* and 16*b* together while providing line contact between them in the flexed state is especially effective to offset the tendency of the footwear to twist and separate the legs of the clamp 12 laterally apart.

The horizontal legs 16*a* and 16*b* are formed 180° to form gripper ends 20*a* and 20*b*. The gripper ends 20*a* and 20*b* have flat terminal ends 21*a* and 21*b*. Plastic caps 22 are slid onto the terminal ends 21 with an interference fit so that they are firmly mounted thereon. The plastic caps 22, each having an enlarged inner surface 23, help spread forces exerted by the clamp 12 on the footwear.

Each of the gripper ends 20*a* and 20*b* is in a plane which is perpendicular to the plane defined by the vertical legs 15*a* and 15*b* and horizontal legs 16*a* and 16*b* of which the gripper end is integral. In addition, each gripper end of a pair of opposing gripper ends 20*a* and 20*b* is formed on the same side of the clamp 12. By forming the gripper ends as such, each clamp 12 can be secured to the heel H of the footwear with the horizontal legs 16*a* and 16*b* proximate to the front wall of the heel so that the sides of the horizontal legs contact the front wall if the footwear begins to twist relative to the clamp. This contact helps counteract twisting of the footwear relative to the clamp 12 and the consequent forces tending to laterally separate the legs.

As an added measure against lateral separation of the legs 15 and 16, a loose fitting metal ring 25 encircles each pair of horizontal legs 16*a* and 16*b*. The ring 25 prevents overflexing and possible permanent deformation of each clamp 12 in handling as well as in extreme conditions of use. Therefore, as shown in FIG. 2, the horizontal leg 16*a* is about one wire diameter away from the front wall of the heel and the horizontal leg 16*b* is about two wire diameters away, with both legs parallel to the front wall. Of course, the legs need not be parallel to the front wall but could be canted relative thereto to provide two points of contact with the front wall, one with the ring 25, and one at the outer end of one of the horizontal legs. Also, some heels are made with concave front walls so that the ring 25 could fit in the depression defined by the concavity and the outer end of each horizontal leg would contact the front wall.

The hanger 10 also includes means for suspending the clamps 12. A hook 27 has a hook shaped upper end 28 and a lower end formed as an eye 29. A yoke 30 has a pair of ends 31 and a balance point 32 midway between the ends 31, with the ends 31 and the balance point 32 each being formed as an eye. The balance point 32 is received by the eye 29 of the hook and the coil 13 of each clamp 12 is received by one of the ends 31.

In normal use, the clamps 12 are strong enough to support the footwear without digging in or marring it. This is possible because each clamp 12 resists the moment which tends to twist the footwear relative to the clamp. Under extreme conditions, such as with 40 lb. waders hung on a rocking and swaying boat, the plastic caps 22 may be removed to concentrate the forces exerted by the clamps on the footwear. Even under these conditions, the clamps 12 advantageously resist the twisting moment which tends to separate the legs to securely support the footwear.

It will be apparent to those skilled in the art that numerous modifications and variations of the preferred embodiment are possible without departing from the spirit or scope of the invention. For example, the coils 13 could be formed with other than one and one-half turns. Hence, it is not intended that the invention be limited to the scope of the preferred embodiment, but only by the claims which follow.

I claim:

1. A footwear hanger for suspending footwear in an inverted position, said footwear having a heel, a sole, and an upper, said hanger comprising a clamp made of wire, said clamp having a torsion spring coil at one end wherein the ends of the coil extend downwardly from the coil to define vertical legs, each said vertical leg being formed inwardly toward the other leg at approximately the same distance from the coil to define horizontal legs in side-to-side contact with one another, said vertical legs crossing one another laterally, and wherein said horizontal legs are formed 180° to define opposed gripper ends to clamp the heel of the footwear between them, and further comprising means for suspending the wire clamp, wherein a pair of said clamps are provided and wherein the suspending means comprises a hook having a lower end formed as an eye, and a yoke having a pair of ends and a balance point midway between the ends with the ends and the balance point each being formed as an eye, the balance point being received by the eye of the hook and the coil of each wire clamp being received by one of the ends, and wherein each gripper end is in a plane which is perpendicular to the plane defined by the vertical and horizontal legs with which the gripper end is integral, both said gripper ends being formed on the same side of the clamp.

2. A footwear hanger for suspending footwear in an inverted position, said footwear having a heel, a sole, and an upper, said hanger comprising a clamp made of wire, said clamp having a torsion spring coil at one end wherein the ends of the coil extend downwardly from the coil to define vertical legs, each said vertical leg being formed inwardly toward the other leg at approximately the same distance from the coil to define horizontal legs in side-to-side contact with one another, said vertical legs crossing one another laterally, and wherein said horizontal legs are formed 180° to define opposed gripper ends to clamp the heel of the footwear between them, and further comprising means for suspending the wire clamp, wherein a pair of said clamps are provided and wherein the suspending means comprises a hook having a lower end formed as an eye, and a yoke having a pair of ends and a balance point midway between the ends with the ends and the balance point each being formed as an eye, the balance point being received by the eye of the hook and the coil of each wire clamp being received by one of the ends, and wherein a loose fitting ring encircles each pair of horizontal legs.

3. A hanger for suspending a pair of footwear in an inverted position, each one of said pair having a heel, a sole, and an upper, said hanger comprising a pair of clamps made of wire, one of said clamps for each one of said pair of footwear, each said clamp having a torsion spring coil at one end wherein front and rear ends of the coil extend downwardly from the coil to define first and second vertical legs, respectively, each vertical leg being formed inwardly toward the other leg at approximately the same distance from the coil to define respective first and second horizontal legs in side-to-side contact with one another, said vertical legs crossing one another laterally so that said first horizontal leg is behind said second horizontal leg, and wherein said horizontal legs are formed 180° to define opposed gripper ends for clamping the heel of the footwear between them, wherein each gripper end is in a plane which is perpendicular to the plane defined by the vertical and horizontal legs with which the gripper end is integral, and both gripper ends are on the same side of the coil, and further comprising means for suspending the wire clamps, said means including a hook having a lower end formed as an eye, and a yoke having a pair of ends and a balance point midway between the ends with the ends and the balance point each being formed as an eye, the balance point being received by the eye of the hook and the coil of each wire clamp being received by one of the ends.

4. A footwear hanger as in claim 3, wherein the horizontal legs are in line contact when the footwear is received between the gripper ends.

5. A footwear hanger as in claim 7, wherein a loose fitting ring encircles each pair of horizontal legs.

6. A hanger for suspending footwear in an inverted position, said footwear having a heel, a sole, and an upper, said hanger comprising a clamp made of wire and having a torsion spring coil at one end wherein front and rear ends of the coil extend downwardly from the coil to define first and second vertical legs, respectively, and each vertical leg is formed inwardly toward the other leg at approximately the same distance from the coil to define respective first and second horizontal legs in side-to-side contact with one another, and wherein said horizontal legs are formed 180° to define opposed gripper ends adapted to clamp the heel of the footwear between them, each said gripper end being in a plane which is perpendicular to the plane defined by the vertical and horizontal legs with which the gripper end is integral and being on the same side of the clamp as the other gripper end, and further comprising means for suspending said wire clamp.

7. A footwear hanger as in claim 6, wherein the first and second vertical legs cross one another laterally so that the first horizontal leg is behind the second horizontal leg.

8. A footwear hanger as in claim 6, wherein a loose fitting ring encircles the horizontal legs.

9. A footwear hanger as in claim 6, wherein a pair of said wire clamps are provided and wherein the suspending means comprises a hook having a lower end formed as an eye, and a yoke having a pair of ends and a balance point midway between the ends with the ends and the balance point each being formed as an eye, the balance point being received by the eye of the hook and the coil of each wire clamp being received by one of the ends.

* * * * *

UNITED STATES PATENT AND TRADEMARK OFFICE

CERTIFICATE OF CORRECTION

PATENT NO. : 4,669,615

DATED : June 2, 1987

INVENTOR(S) : Donald J. Zigman

It is certified that error appears in the above—identified patent and that said Letters Patent is hereby corrected as shown below:

In column 6, line 4, change "claim 7" to -- claim 4 --.

Signed and Sealed this

Thirteenth Day of October, 1987

*Attest:*

DONALD J. QUIGG

*Attesting Officer*

*Commissioner of Patents and Trademarks*